US006887104B2

(12) United States Patent
Lee

(10) Patent No.: US 6,887,104 B2
(45) Date of Patent: May 3, 2005

(54) CABLE END CONNECTOR ASSEMBLY AND THE METHOD OF MAKING THE SAME

(75) Inventor: George Lee, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/293,537

(22) Filed: Nov. 12, 2002

(65) Prior Publication Data

US 2004/0092164 A1 May 13, 2004

(51) Int. Cl.[7] ..... H01R 13/58; H01R 13/64; H01R 13/00

(52) U.S. Cl. ..... 439/606; 439/449; 439/374

(58) Field of Search ..... 439/606, 449, 439/374, 455, 733.1

(56) References Cited

U.S. PATENT DOCUMENTS 4,737,117 A * 4/1988 Lockard ..... 439/92
5,163,856 A 11/1992 McGaffigan et al.
5,741,147 A * 4/1998 Konoya et al. ..... 439/189
6,007,366 A * 12/1999 Torii et al. ..... 439/397
6,027,374 A * 2/2000 Nagai et al. ..... 439/596
6,203,376 B1 * 3/2001 Magajne et al. ..... 439/610
6,361,357 B1 3/2002 Stillwell et al.
6,402,552 B1 6/2002 Wagner
6,443,773 B1 * 9/2002 Korsunsky et al. ..... 439/660
6,488,540 B1 * 12/2002 Coyle et al. ..... 439/650
6,551,119 B1 * 4/2003 Sakamoto et al. ..... 439/287
2003/0003793 A1 * 1/2003 Chang ..... 439/402

* cited by examiner

*Primary Examiner*—Chandrika Prasad
(74) *Attorney, Agent, or Firm*—Wei Te Chung

(57) ABSTRACT

A cable end connector assembly (1) includes a dielectric housing (2), a plurality of contact units (3), a plurality of wires (6), and a cover (5). The housing includes an upper wall (20), a lower wall (21), and a pair of sidewalls (251, 252) connecting the upper and lower walls. Each contact unit comprises at least one mating portion (32) and a tail portion (33) opposite to the mating portion and extending beyond a rear face of the housing. The tail portion has a U-shaped configuration. Each wire comprises a conductive core (60) received in corresponding U-shaped tail portion and soldered with the tail portion to form electrical connection therebetween. The cover is over-molded with a rear end (26) of the housing and covers front ends of the wires and the tail portions of the contact units to protect the electrical connection between the wires and the contact units.

18 Claims, 9 Drawing Sheets

CABLE END CONNECTOR ASSEMBLY AND THE METHOD OF MAKING THE SAME

BACKGROUND OF THE INVENTION

1. Field of the Invention

The present invention generally relates to a cable end connector assembly, and more particularly to a Serial Advanced Technology Attachment (Serial ATA) cable end connector assembly which can reliably and securely terminate wires of a cable for providing good transmission performances.

2. Description of Related Art

A cable end connector assembly needs to terminate wires of a cable. Connection of wires of a cable with terminals of a connector can be attained in several ways, such as by applying the insulation displacement connection (IDC) technology, by using a printed circuit board which interconnects the cable and the connector, or by applying the crimp technology.

There also exists in the art an electrical connector known as a Serial ATA connector which is generally used for disk drives and storage peripherals connecting with a mother board. A Serial ATA cable end connector assembly comprises a housing with a plurality of terminals therein and a cable having a plurality of wires. The terminals need to terminate the wires of the cable reliably for achieving good transmission performances.

U.S. Pat. No. 6,402,552 (the Pat. '552) discloses such a Serial ATA cable end connector assembly having a plurality of terminals attached to conductive wires of a cable respectively. However, firstly it requires initially making a contact module via insert molding which complicates the manufacturing process and costs more money in comparison with the traditional insertion of the contacts into the housing. Secondly, the termination between the terminals and the wires is not disclosed in connector structure and manufacturing method thereof. Hence, it is desired to have a cable end connector assembly with terminals thereof terminating conductive wires of a cable reliably.

SUMMARY OF THE INVENTION

An object of the present invention is to provide a cable end connector assembly which terminates wires reliably and durably.

In order to achieve the objects set forth, a cable end connector assembly in accordance with the present invention comprises a dielectric housing, a plurality of contact units, a plurality of wires, and a cover. The housing comprises an upper wall, a lower wall, and a pair of sidewalls connecting the upper and lower walls. A receiving space is defined in the housing adapted for receiving a mating portion of a complementary connector. Each contact unit comprises at least one mating portion adapted for electrically connecting the complementary connector, and a tail portion opposite to the mating portion and extending beyond a rear face of the housing. The tail portion has a U-shaped configuration. Each wire comprises a conductive core received in corresponding U-shaped tail portion and soldered with the tail portion to form electrical connection therebetween. The cover is overmolded with a rear end of the housing and covers front ends of the wires and the tail portions of the contact units to protect the electrical connection between the wires and the contact units.

Other objects, advantages and novel features of the invention will become more apparent from the following detailed description when taken in conjunction with the accompanying drawings.

DETAILED DESCRIPTION OF THE INVENTION

Figure 1:
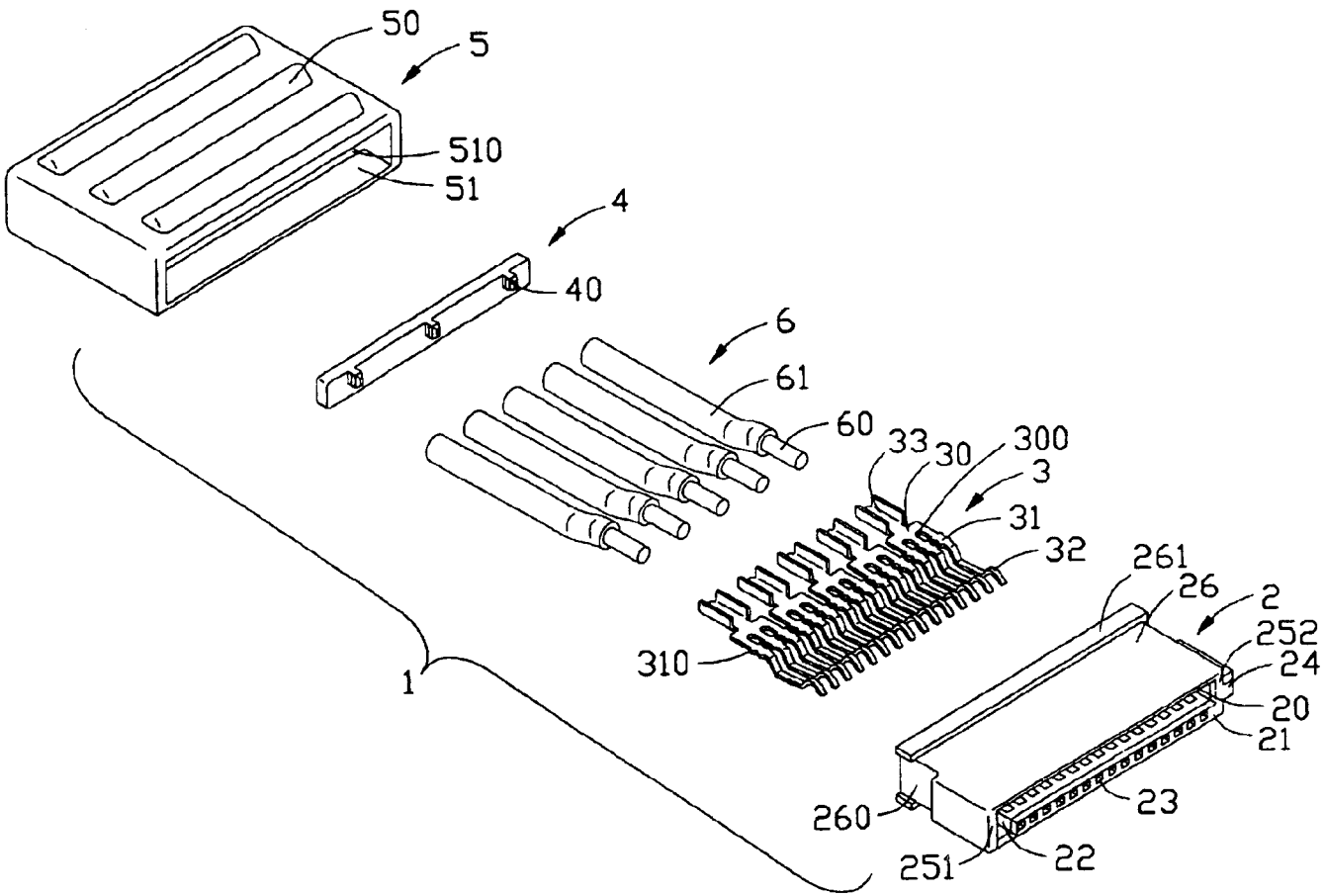
FIG. 1 is an exploded, perspective view of a cable end connector assembly in accordance with the present invention.
Figure 2:
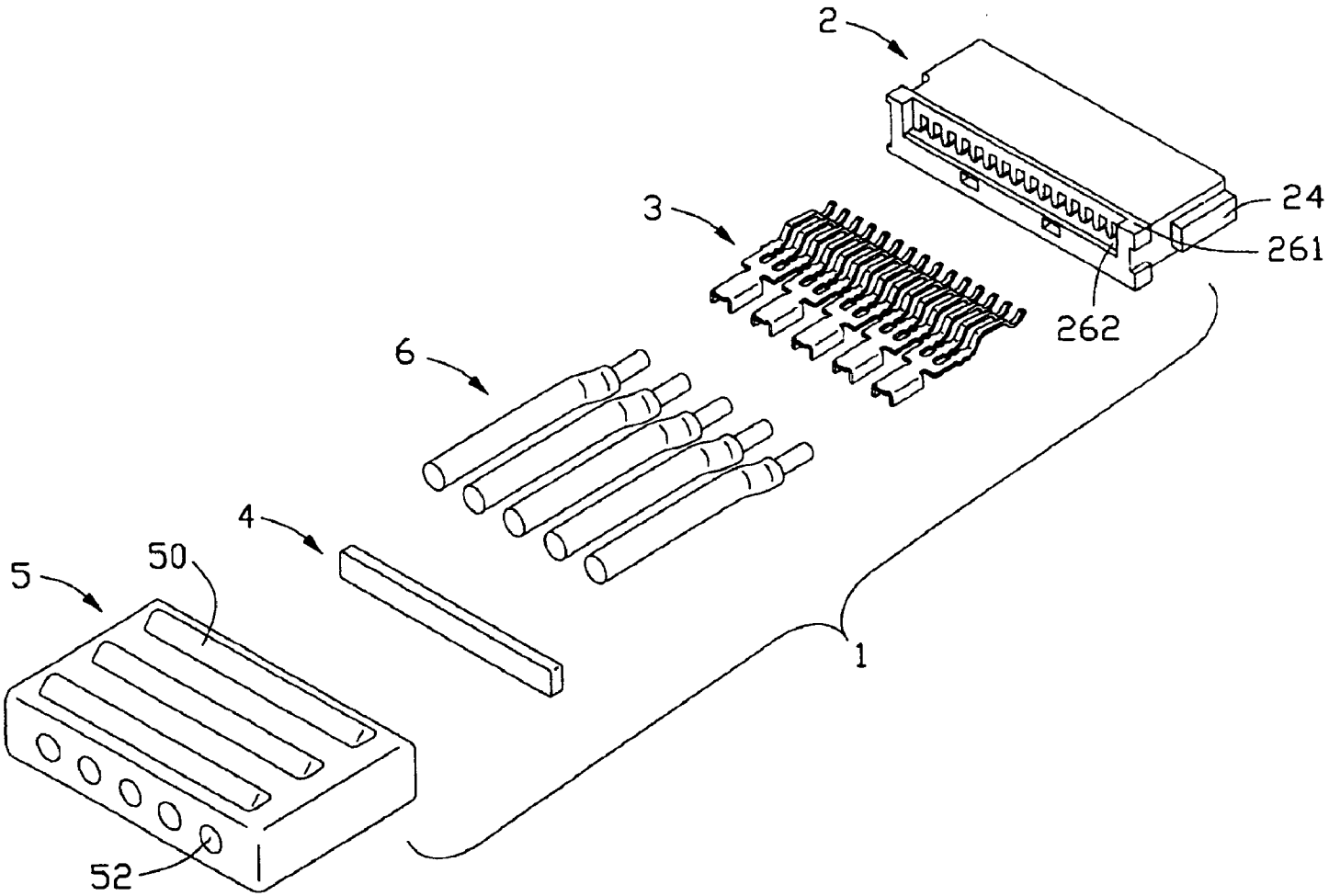
FIG. 2 is a view similar to FIG. 1, but taken from rear and bottom aspects.
Figure 3:
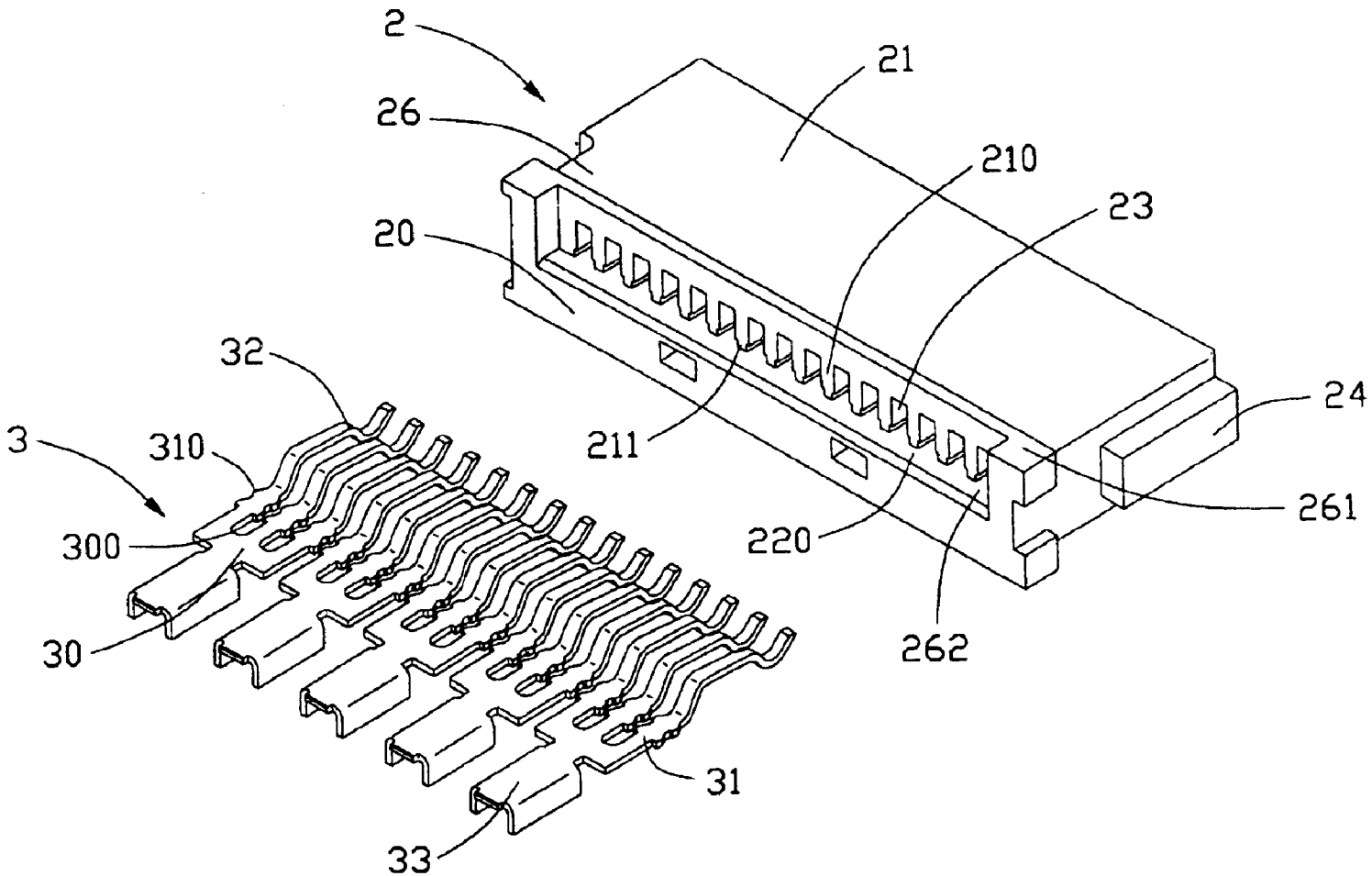
FIG. 3 is an exploded, perspective view of a dielectric housing and contact units of the cable end connector assembly from rear and bottom aspects.

Referring to FIGS. 1 and 2, and in conjunction with FIG. 3, a cable end connector assembly 1 in accordance with the present invention comprises a dielectric housing 2, a plurality of contact units 3, a spacer 4, a cover 5, and a plurality of wires 6. In the preferred embodiment of the present invention, the cable end connector assembly 1 is in the form of a Serial ATA cable end connector assembly.

The dielectric housing 2 comprises an upper wall 20, a lower wall 21 opposite to the upper wall 20, and first and second sidewalls 251, 252 connecting the upper and lower walls 20, 21. The upper wall 20, the lower wall 21, and the first and second sidewalls 251, 252 together define an L-shaped receiving space 22 in a front end of the housing 2. A slit 220 is defined between the upper and lower walls 20, 21 from a rear end 26 of the housing 2 and communicates with the receiving space 22. A plurality of dividing blocks 210 is formed on the lower wall 21 of the housing 2. A passageway 23 is defined between each two dividing blocks 210 and extending through the lower wall 21. The passageways 23 communicate with the slit 220 in the rear end 26 of the housing 2 and communicate with the receiving space 22 in the front end of the housing 2. Each dividing block 210 forms a thinner portion 211 on an upper end thereof. A guiding projection 24 protrudes sidewardly from a side surface of the second sidewall 252 for mating with a complementary connector. A cutout 260 is defined in a rear of the first sidewall 251 so as for decreasing a transverse size of the rear end 26 of the housing 2. A pair of ribs 261 is formed on an upper surface and a lower surface of the housing 2 and adjacent to the rear end 26 of the housing 2. A pair of opposite ends of each rib 261 extends beyond the side surface of second sidewall 252 and an outer surface of the cutout 260 respectively for engaging with the cover 5. A receiving cutout 262 is defined in the rear end 26 of the housing 2 and communicates with the passageways 23 and the slit 220 for receiving the spacer 4 therein.

Each contact unit 3 has a fork-shaped configuration and comprises a base portion 30, three retention portions 31 extending forwardly from a middle and a pair of sides of the base portion 30 respectively, three mating portions 32 extending forwardly from corresponding retention portion 31, and a U-shaped tail portion 33 extending rearwardly from a rear edge of the base portion 30. Each retention portion 31 forms a plurality of barbs 310 on a pair of sides thereof. A front edge 300 of the base portion 30 is formed between each two retention portions 31.

The spacer 4 is a rectangular bar and a plurality of retention protrusions 40 projects from a front surface thereof.

The cover 5 is preferably comprised of molded plastic or polymer material and over-molded with the rear end 26 of the housing 2 and the front ends of the wires 6. A plurality of ribs 50 is formed on upper and lower surfaces of the cover 5 for being grasped conveniently. A receiving cavity 51 is defined in a front portion of the cover 5 for receiving the rear end 26 of the housing 2. A plurality of receiving holes 52 is defined in the rear portion of the cover 5 corresponding to the wires 6. A pair of slots 510 is defined in an inner upper wall and an inner lower wall of the cover 5 for receiving the pair of ribs 261 of the housing 2 therein. Each slot 510 is deeper and wider than the receiving cavity 51.

Each wire 6 comprises a conductive core 60 surrounded by an outer insulating cover 61.

Figure 4:
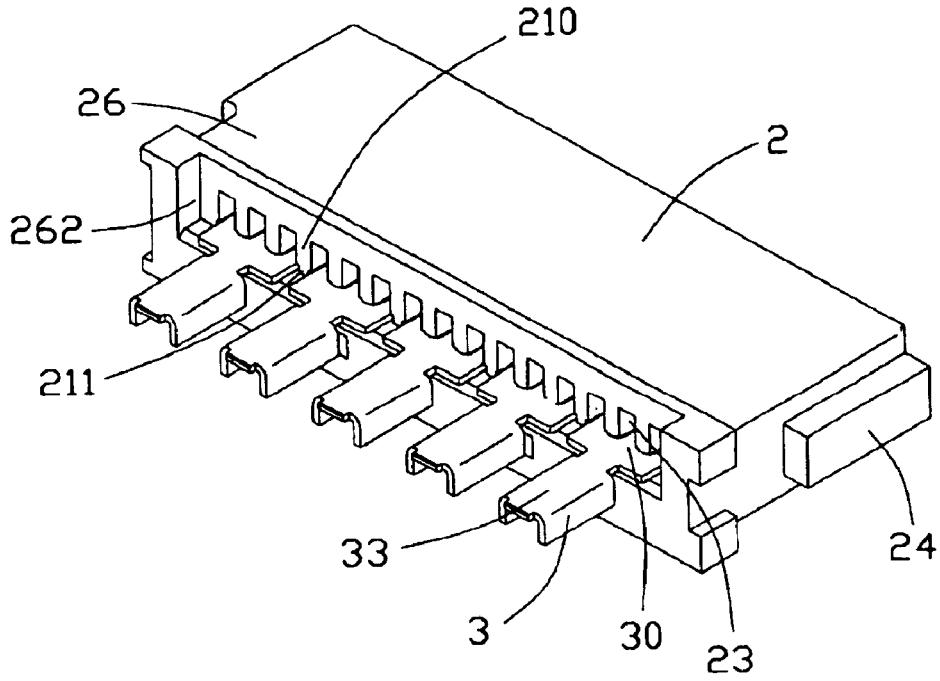
FIG. 4 is an assembled view of FIG. 3.

In assembly, referring to FIG. 4, the contact units 3 are first inserted into the dielectric housing 2 from the slit 220 in a rear-to-front direction until the front edge 300 of each base portion 30 abuts against a rear surface of corresponding dividing block 210. Each mating portion 32 of the contact unit 3 protrudes through and is received in corresponding passageway 23 and is partly exposed in the receiving space 22 for electrically connecting the complementary electrical connector. Each retention portion 31 of the contact unit 3 is received in corresponding passageway 23 and the barbs 310 engage with opposite side surfaces of two adjacent thinner portions 211. The U-shaped tail portion 33 of each contact unit 3 is exposed beyond a rear surface of the housing 2 for being soldered with corresponding front end of the wire 6.

Figure 5:
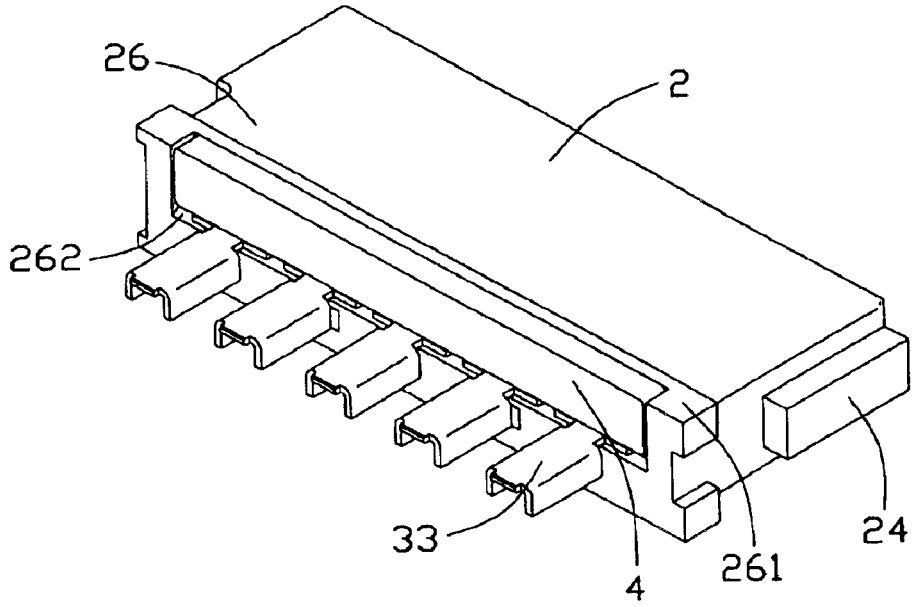
FIG. 5 is an assembled view of the dielectric housing, the contact units and a spacer from rear and bottom aspects.

Now referring to FIG. 5, the spacer 4 is pushed and received into the receiving cutout 262 defined in the rear end 26 of the housing 2. The retention protrusions 40 engage with opposite inner surfaces of two adjacent dividing blocks 210 so as for securing the spacer 4 to the housing 2 firmly (referring to FIG. 9). The spacer 4 seals the rear end 26 of the housing 2 and efficiently prevents melted plastic material of the cover 5 from entering into the housing 2 and influencing the electrical connection between the cable end connector assembly 1 and the complementary connector.

Figure 6:
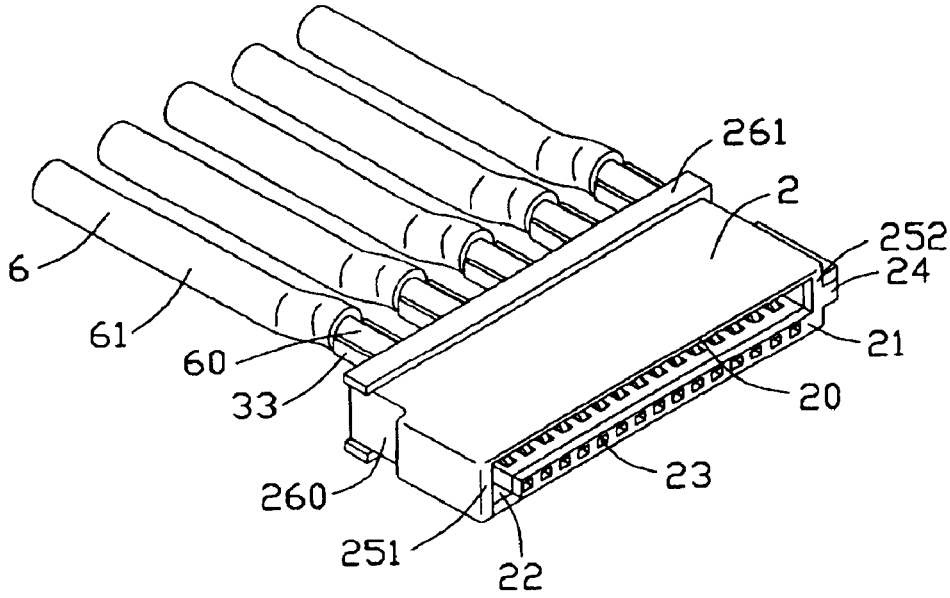
FIG. 6 is an assembled view of the cable end connector assembly without a cover.
Figure 7:
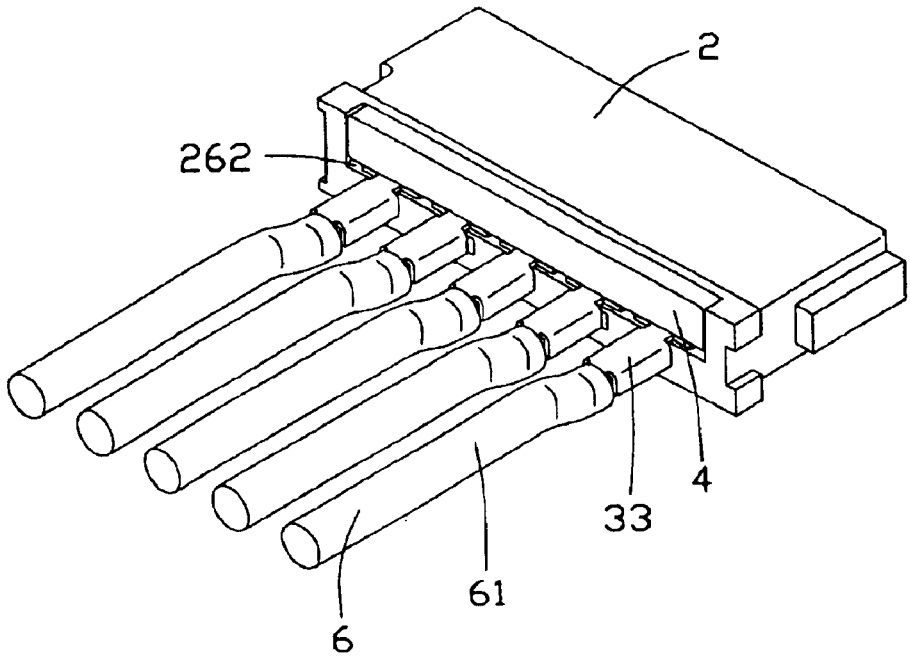
FIG. 7 is a view similar to FIG. 6, but taken from rear and bottom aspects.

Referring to FIGS. 6 and 7, the conductive cores 60 of the wires 6 are received and soldered onto the tail portions 33 of the contact units 3 respectively. The U-shaped tail potion 33 increases the contact area between the tail portion 33 and the conductive core 60, thus assures reliable connection therebetween.

Figure 8:
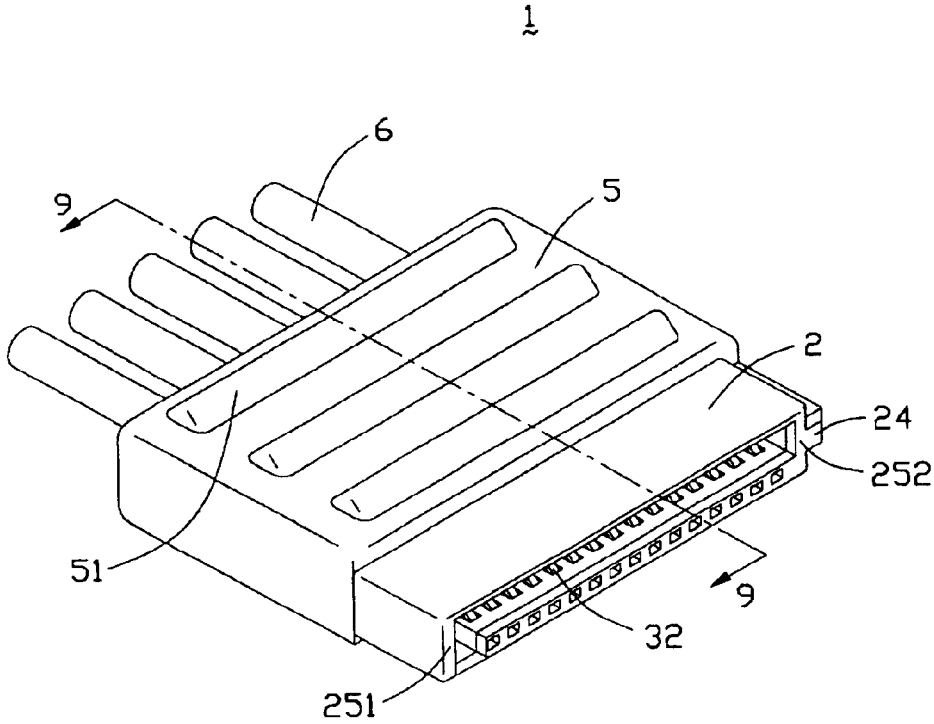
FIG. 8 is an assembled view of the cable end connector assembly of FIG. 1.
Figure 9:
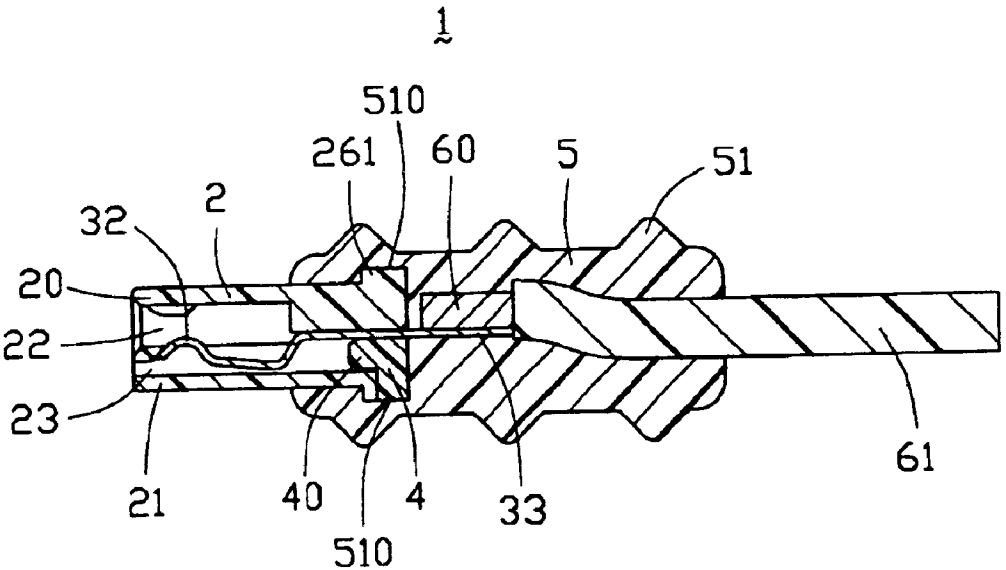
FIG. 9 is a cross-sectional view taken along line 9—9 of FIG. 8.

Referring to FIGS. 8 and 9, The cover 5 is at last over-molded with the rear end 26 of the housing 2 and the front ends of the wires 6. The rear end 26 is received in the receiving cavity 51 with the pair of ribs 261 received in the pair of slots 510. The opposite ends of the ribs 261 engage with inner side surfaces of the slots 510. Each wire 6 is received in corresponding receiving hole 52. The cover 5 forms a strain relief between the housing 2 and the wires 6, and also protects the electrical connections between the U-shaped tail portions 33 and the conductive cores 60.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly adapted for mating with a complementary electrical connector, comprising:

a dielectric housing defining a plurality of passageways extending in a front-to-back direction and comprising an upper wall, a lower wall opposite to the upper wall, and a pair of sidewalls connecting the upper and lower walls, a receiving space being defined by the upper wall, the lower wall and the pair of sidewalls and communicating with the passageways and adapted for receiving a mating portion of the complementary connector;

a plurality of contact units respectively received in the passageways, each contact unit comprising three mating portions at one end thereof partially exposed into tho receiving specs and adapted for electrically connecting the complementary connector, and a tail portion connected to the three mating portions and extending beyond a rear face of the housing, wherein the tail portion has a U-shaped configuration;

a plurality of wires extending in said front-to-back direction and each comprising a conductive core received in and soldered with the U-shaped tail portion of a corresponding contact unit to form electrical connection therebetween; and a cover over-molded with a rear end of the housing and coveting front aids of the wires and the tail portion of the contact units to protect the electrical connection between the wires and the contact units;

further comprising, a spacer received in the rear end of the dielectric housing for preventing the melted plastic material of the cover from entering into the dielectric housing.

2. The cable and connector assembly as claimed in claim 1, wherein the contact unit comprises a base portion interconnecting the three mating portions and the tail portion.

3. The cable end connector assembly as claimed in claim 2, wherein the lower wall of the housing forms a plurality of dividing blocks from a rear end thereof, front edges of the base portion of each contact unit formed between two adjacent retention portions abut against rear surfaces of the dividing blocks.

4. The cable end connector assembly as claimed in claim 3, wherein each contact unit comprises three retention portions extending forwardly from the base portion and each retention portion forms a plurality of barbs on a pair of sides thereof and engaging with opposite side surfaces of two adjacent dividing blocks.

5. The cable end connector assembly as claimed in claim 1, wherein the spacer forms a plurality of retention protrusions respectively engaging with opposite inner surfaces of two adjacent dividing blocks for securing the spacer to the housing firmly.

6. The cable end connector assembly as claimed in claim 5, wherein the dielectric housing defines a receiving cutout in the rear end thereof and communicating with the passageways, said spacer is pushed and received in the receiving cutout, the retention protrusions are received into corresponding passageways.

7. The cable end connector assembly as claimed in claim 1, wherein the cover defines a front receiving cavity receiving the rear end of the housing therein and a plurality of receiving holes defined in a rear end of the cover allowing the wires extending through.

8. The cable end connector assembly as claimed in claim 7, wherein a pair of slots is defined in en inner upper wall and an inner lower wall of the cover, and wherein die housing forms a pair of ribs respectively received in the slots.

9. The cable end connector assembly as claimed in 1, wherein a guiding projection protrudes sidewardly from one sidewall of the housing adapted for properly guiding insertion of the complementary connector.

10. A cable end connector assembly adapted for mating with a complementary connector, comprising:

a dielectric housing defining a receiving apace in a front-to-back direction thereof adapted for receiving a mating portion of the complementary connector;

a plurality of contacts received in the dielectric housing;

a spacer assembled to a rear end of the housing;

a plurality of wires extending in said front-to-back direction and each comprising a conductive core electrically connecting whit corresponding contact; and a cover over-molded with the rear end of the housing and front ends of the wires to protect the electrical connection between the wires and the contacts, wherein the spacer seals the rear end of the housing and prevent melted plastic material from entering into the housing when molding.

11. The cable end connector assembly as claimed in claim 10, wherein each contact has a fork-shaped configuration and comprises a body portion, three retention portions extending forwardly from the base portion, three mating portions extending forwardly front corresponding retention portions, and a tail portion extending rearwardly from the body portion.

12. The cable end connector assembly as claimed in claim 11, wherein each tail portion is U-shaped and is soldered with the conductive core of corresponding wire.

13. The cable end connector assembly as claimed in claim 12, wherein the receiving space is L-shaped, and wherein the dielectric housing defines a plurality of passageways to communicate with the receiving space and to receive the contacts.

14. The cable end connector assembly as claimed in claim 13, wherein the spacer forms a plurality of retention protrusions on a surface thereof, the retention protrusions being received into the corresponding passageways.

15. The cable end connector assembly as claimed in claim 12, wherein the housing defines a receiving cutout in the rear end thereof, said spacer is pushed and received into the receiving cutout.

16. The cable end connector assembly as claimed in claim 10, wherein the housing defines a plurality of forwardly extending passageways to receive a plurality of curved mating portions of said contacts, and each of said contacts further includes a tail section extending out of the rear end of the housing and solderably secured to the corresponding conductive cores, respectively, wherein said spacer substantially segregate said conductive cores from the corresponding respective passageways.

17. The cable and connector assembly as claimed in claim 16, wherein said tail section extends in a front-to-back direction along the corresponding passageway.

18. A method of making a cable end connector, comprising:

providing an insulative housing with a plurality of passageways extending in a front-to-back direction;

inserting a plurality of contacts into the corresponding passageways with thereof a plurality of tail sections exposed out of a rear portion of the housing;

assembling a spacer to the rear portion of the housing to segregate the tail sections from the corresponding passageways, respectively, in said front-to-back direction;

providing a cable extending in said front-to-back direction with a plurality of wires having inner conductive cores, respectively;

soldering front portions of the conductive cores to the corresponding tail sections, respectively; and overmolding said rear portion of said housing and a front portion of the cable to enclose said spacer, said tail sections and the front portions of said conductive cores.

* * * * *